United States Patent [19]

Bay et al.

[11] Patent Number: 4,701,269

[45] Date of Patent: Oct. 20, 1987

[54] WATERPROOFING LEATHER AND SKINS

[75] Inventors: Herbert Bay, Reutlingen; Rudi Widder, Leimen; Guenter Eckert, Limburgerhof, all of Fed. Rep. of Germany

[73] Assignee: BASF Aktiengesellschaft, Ludwigshafen, Fed. Rep. of Germany

[21] Appl. No.: 895,686

[22] Filed: Aug. 13, 1986

[30] Foreign Application Priority Data

Aug. 21, 1985 [DE] Fed. Rep. of Germany ..... 3529869

[51] Int. Cl.[4] ..... C14C 9/00

[52] U.S. Cl. ..... 252/8.57; 8/94.1 R

[58] Field of Search ..... 8/94.18, 94.1; 427/387, 427/379; 252/8.57

[56] References Cited

U.S. PATENT DOCUMENTS

| | | | |
|---|---|---|---|
| 2,662,039 | 12/1953 | Brown et al. | 252/8.6 |
| 3,832,203 | 8/1974 | Saunders et al. | 427/387 |

FOREIGN PATENT DOCUMENTS

| | | | |
|---|---|---|---|
| 0047922 | 11/1983 | European Pat. Off. . | |
| 2439199 | 3/1976 | Fed. Rep. of Germany . | |
| 0215393 | 10/1964 | U.S.S.R. | 8/94.18 |

*Primary Examiner*—Paul Lieberman
*Assistant Examiner*—John F. McNally
*Attorney, Agent, or Firm*—Oblon, Fisher, Spivak, McClelland, & Maier

[57] ABSTRACT

A process for waterproofing leather and skins with a silicone oil and the salt of an N-($C_9$–$C_{20}$-acyl)-amino acid as an emulsifier for the silicone oil, which is carried out in the aqueous phase during or after retanning, and the use of salts of N-acylamino acids as emulsifiers for silicone oils in the waterproofing of leather and skins in the aqueous phase, and the mixtures used for this purpose.

7 Claims, No Drawings

WATERPROOFING LEATHER AND SKINS

The present invention relates to a process for waterproofing leather and skins with a silicone oil and a salt of N-($C_9$-$C_{20}$acyl)-amino acid as an emulsifier for the silicone oil, which is carried out in the aqueous phase during or after retanning, and the use of salts of N-($C_9$-$C_{20}$acyl)-amino acids for emulsifying silicone oil in the aqueous phase during the waterproofing of leather and skins, and the mixtures used for this purpose.

A very wide variety of processes for waterproofing leather and skins has been disclosed. For example, silicone oils too, are used for this finishing stage. The polysiloxanes used are always employed in solution in organic solvents, such as gasoline or chlorohydrocarbons. The disadvantages of using these solvents are their harmful effect on health and the environmental pollution they cause and the danger of fire where gasoline is used. Waterproofing with the aid or organic solvents also entails an additional operation and hence substantially greater expense.

N-Acylamino acids, in particular fatty acid sarcosides, e.g. N-oleoylsarcosine, in the form of their salts, are known emulsifiers for paraffins and waxes, which, for example, can also be used for waterproofing leather. The effects achievable with waxes and paraffins are not always sufficient to meet the high present-day requirements and are as a rule supplemented by separate subsequent waterproofing with, for example, fluorine chemicals or silicone oils, which are applied from the organic phase.

It is an object of the present invention to provide a process for waterproofing leather and skins, in which organic solvents are not required and waterproofing can be effective with a silicone oil in the aqueous phase, and the effect on the performance characteristics of leather and skins should be equivalent to or better than that of silicone oils applied from organic solvents.

We have found that this object is achieved by a process for waterproofing leather and skins, in which a silicone oil together with a salt of an N-($C_9$-$C_{20}$-acyl)-amino acid as an emulsifier in an aqueous liquor is allowed to act on the leather or skins being finished, either during or after retanning.

The invention is based on the observation that N-($C_9$-$C_{20}$-acyl)-amino acids, in particular fatty acid sarcosides, in the form of their salts are outstanding emulsifiers of silicone oils, so that it has been possible for the first time to demonstrate their use in waterproofing leather and skins in aqueous liquor. Sufficiently stable aqueous emulsions of silicone oils have been obtained for the intended uses employing solely the emulsifier described, without additional further assistants. This is all the more surprising since the emulsifiers to be used according to the invention can be absorbed by the leather during use, so that destabilization of the emulsion would have been expected.

The present invention relates to a process for waterproofing leather and skins with a silicone oil in the presence of a salt of an N-($C_9$-$C_{20}$-acyl)-amino acid as an emulsifier, wherein (a) an aqueous emulsion of a silicone oil, consisting of from 15 to 90% by weight of silicone oil, from 5 to 30% by weight of a salt of an amino acid of 2 to 6 carbon atoms which has an acyl radical of a saturated or unsaturated fatty acid of 9 to 20 carbon atoms on the amino nitrogen atom, which may additionally be substituted by methyl, and from not less than 5% by weight to the remainder to 100% by weight of water, the emulsion being brought to pH 5–12, preferably 7–10, with an alkali metal hydroxide, ammonia or an alkanolamine, or (b) an anhydrous mixture of from 70 to 90% by weight of a silicone oil and from 10 to 30% by weight of an alkanolamine salt of an amino acid of 2 to 6 carbon atoms which has an acyl radical of a saturated or unsaturated fatty acid of 9 to 20 carbon atoms on the amino nitrogen atom, which may additionally by substituted by methyl, in an amount of from 0.5 to 20% by weight, based on the shaved weight of the leather or wet weight of the skins, is allowed to act on the leather or skins being treated, in an aqueous liquor at pH 4.5–8.0, during or after retanning, after which the pH is brought to 3.0–5.0 and, if required, the leather or skins are after-treated in the aqueous solution with a divalent, trivalent or tetravalent metal salt conventionally used in tanning.

The present invention furthermore relates to the use of amino acids of 2 to 6 carbon atoms which have an acyl radical of a saturated or unsaturated fatty acid of 9 to 20 carbon atoms on the amino nitrogen atom, which may automatically be substituted by methyl, in the form of an alkali metal, ammonium or alkanolamine salt, for emulsifying silicone oil in the aqueous phase during the waterproofing of leather and skins during or after retanning.

The present invention therefore also relates to the use of the aqueous emulsion (a) or of the anhydrous mixture (b) of the composition stated above in aqueous liquors for waterproofing leather or skins during or after retanning, in an amount of from 0.5 to 20% by weight, based on the shaved weight of the leather or wet weight of the skins.

The particular advantage of the novel process is that an emulsifier for the silicone oil has been found which emulsifies the silicone oil in a simple procedure avoiding organic solvents to a sufficient extent, so that the silicone oil can penetrate the leather, and thereafter, by adding acid and, if required, a polyvalent metal salt, the N-acylamino acid salt used is rendered ineffective as an emulsifier, with the result that the silicone oil displays its full water-repellent action. It should be emphasized that the presence of organic solvents and additional assistants, for example nonionic emulsifiers, can be avoided.

Suitable silicone oils are the commercial silicone oils having a viscosity of from 30 to 1000, preferably from 80 to 500 mPa.s. The skilled worker can easily find such silicone oils described in, for example, Rompps Chemielexikon, 7th edition, Stuttgart, 1975, page 3223 et seq., or Ullmanns Enzyklopädie der techn. Chemie, 4th edition, 1982, volume 21, page 512 et seq. Examples of suitable silicone oils are those in which the residual valencies of the silicon are saturated by hydrocarbon radicals, in particular methyl, or ethyl, propyl or plenyl. Very particularly preferred silicone oils are those in which some of the hydrocarbon radicals carry functional organic groups, such as amino, mercapto or carboxyl. Because of these functional groups, they are easier to emulsify and consequently bind better to the leather fibers. The stated viscosities are a practical measure of the molecular weights, which in many cases can be determined only at great expense.

Preferred silicone oils are dimethylpolysiloxanes having a viscosity of from 80 to 110 mPa.s, phenylmethylpolysiloxanes having a viscosity of from 85 to 120 mPa.s, dimethylpolysiloxanes possessing amino groups as reactive groups and characterized by an amine number of about 0.81.0 and a viscosity of from 30 to 50 mPa.s, and dimethylpolysiloxanes possessing carboxyl groups as reactive groups having on average from 2 to 10 carboxyl groups per molecule.

Very particularly preferrred dimethylpolysiloxanes are those in which some of the methyl groups are replaced by mercaptopropyl ($CH_2$-$CH_2$-$CH_2$-SH) or aminopropyl (-$CH_2$-$CH_2$-$CH_2$-$NH_2$) as reactive groups. As a rule, from 1 to 5, preferably about 3, % of the methyl groups in the chain are replaced by these reactive substituents. These are commercial dimethylpolysiloxanes possessing terminal —$Si(CH_3)_3$ groups, which may be characterized by a viscosity of from 130 to 200, preferably from 145 to 180, mPa.s. The preferred and particularly preferred silicone oils are commercial products.

Among the N-($C_9$-$C_{20}$-acyl)-amino acids of 2 to 6 carbon atoms, those of 2 to 4 carbon atoms where the amino group is $\alpha$ to the carboxyl group and the amine nitrogen atom is additionally substituted by methyl are preferred. Among these, the fatty acid sarcosides of saturated or unsaturated fatty acids of 9 to 20, preferably 16 to 18, carbon atoms, have a particularly superior effect.

Suitable salts are the alkali metal salts, in particular the salts of sodium or potassium, the ammonium salts and salts of a mono-, di- or trialkanolamine where the alkanol radical is of 2 to 4 carbon atoms, in particular salts of mono-, di- or triethanolamine.

Oleic acid sarcoside and N-oleolsarcosine (medialanic acid) is a particularly preferred sarcoside. Other particularly noteworthy compounds are N-stearoylsarcosine, N-lauroylsarcosine and N-isononanoylsarcosine, in each case in the form of the abovementioned salts.

The silicone oil and the salt of the N-acylamino acid are advantageously used in the form of an aqueous emulsion, as a concentrate, consisting of from 15 to 90% by weight of one of the silicone oils defined above, from 5 to 30% by weight of one of the salts of an N-($C_9$–$C_{20}$-acyl)-amino acid defined above and from not less than 5% by weight to the remainder to 100% by weight of water, the pH being brought to 5–12, preferably 7–10, with an alkali metal hydroxide, ammonia or an alkanolamine. The preferred concentrate contains from 30 to 60% by weight of silicone oil, from 5 to 30% by weight of a salt of an N-($C_9$-$C_{20}$-acyl)-amino acid and from 65 to 10% by weight of water, the pH being brought to a very preferred range of from 7.5 to 8.5.

In another embodiment, an anhydrous concentrate consisting of from 70 to 90% by weight of silicone oil and from 10 to 30% by weight of one of the N-acylamino acids defined above, in the form of a mono-, di- or trialkanolamine salt, is used.

When such an anhydrous mixture is added to the aqueous liquor, the silicone oil is automatically emulsified in the aqueous phase by the salt used.

It should be pointed out that the aqueous emulsion defined above is preferably used as the concentrate.

The waterproofing according to the invention may be combined with a conventional waterproofing agent based on, for example, a paraffin emulsion or wax emulsion, ie. may be carried out simultaneously with or after conventional waterproofing in an aqueous liquor. A substantial improvement in the waterproofing effects is achieved in this way.

The concentrates described above may additionally contain from 5 to 45, preferably from 10 to 30, % by weight, based on the total weight of the mixture, of solid and/or liquid paraffin, for example paraffin having a melting point of from 20° to 100° C., paraffin oil or white oil, a natural fat or oil, such as fish oil or bone oil, or a synthetic or natural wax, such as polyethylene waxes, polyisobutylene waxes, beeswax or carnauba wax, the weight ratio of silicone oil to paraffin advantageously not exceeding 1:1. Solid paraffin having a melting point of from 40° to 60° C. and white oil are particularly preferred for such a combination. The stated amounts of paraffin, fats, oils or waxes are taken up by the concentrates without difficulty.

In practice, a concentrate as defined above is used in an amount of from 0.5 to 20, preferably from 2 to 10, % by weight, based on the shaved weight of the leather or wet weight of the skins, during or after retanning, if desired together with dyes. Advantageously, the concentrate used is diluted with water in a ratio of 1:2 to 1:5 and added to the working liquor.

The waterproofing according to the invention may also be carried out in two stages during and after retanning. Advantageous tanning agents for retanning are vegetable tanning agents and synthetic tanning agents for example those based on phenolsulfonic acid/formaldehyde condensates. Examaples of dyes which may also be present are the conventional acidic, substantive or basic aniline dyes used.

The actual waterproofing according to the invention, during or after retanning, is carried out with drumming in a suitable apparatus in a conventional manner, i.e. at a liquor length of from 50 to 2000, preferably from 100 to 400, %, based on the shaved weight of the leather or wet weight of the skins, and at from 20° to 60° C., preferably 35° to 50° C., the pH generally being from 4.5 to 8.0, preferably from 4.8 to 5.5, at the beginning. In general, waterproofing is complete in from 20 to 240, preferably from 30 to 120, minutes.

When waterproofing is complete, the emulsifier is fixed with an acid, preferably formic acid, by bringing the pH to 3.0–5.0, preferably 3.8 to 4.0.

The waterproofing effect can be reinforced by aftertreatment with a divalent, trivalent or tetravelent metal salt conventionally used in tanning, in particular a basic chromium sulfate, aluminum sulfate, zirconium sulfate, titanium sulfate, calcium chloride or magnesium sulfate.

From 0.5 to 5, preferably from 1 to 2, % by weight, based on the shaved weight of the leather or wet weight of the skins, of the stated salts are advantageously used. Among the salts mentioned, basic chromium sulfates and aluminum sulfate are preferred.

EXAMPLES

Parts and percentages are by weight, unless stated otherwise.

A. Preparation of silicone oil mixtures used according to the invention

EXAMPLE 1

49.2 of a dimethylpolysiloxane in which 3% of the methyl groups in the chain are replaced by mercaptopropyl and which has a viscosity of 150 mPa.s and 9.8 parts of N-oleoylsarcosine (oleic acid sarcoside) are mixed by stirring, and heated to 60° C. A mixture of 37.2 parts of water and 1.8 parts of 50% strength aqueous sodium hydroxide solution, which has been heated to 60° C., is then added slowly to the stirred mixture.

Complete conversion to the sodium salt is indicated by the fact that the pH remains constant. The pH of the mixture is then brought to 7.5–8.0, and the prepared mixture is left to cool, while stirring.

EXAMPLE 2

79.0 parts of a dimethylpolysiloxane in which 3% of the methyl groups in the chain are replaced by mercaptopropyl and which has a viscosity of 150 mPa.s and 15 parts of N-oleoylsarcosine are mixed, and the mixture is heated to 60° C., while stirring. Thereafter, 6.0 parts of 100% pure diethanolamine are added to the stirred mixture at 60° C., and the prepared mixutre is left to cool while stirring.

EXAMPLE 3

41.3 parts of water and 3.7 parts of 25% strength aqueous sodium hydroxide solution are mixed, and heated to 60° C. A mixture of 30.0 parts of a dimethylpolysiloxane in which 3% of the methyl groups are replaced by mercaptopropyl and which has a viscosity of 180 mPa.s, 6.0 parts of solid paraffin having a melting point of 52°–54° C., 9.5 parts of white oil and 9.5 parts of N-oleoylsarcosine is preheated to 60° C. and then stirred into the dilute sodium hydroxide solution. Stirring is continued at 60° C. until the pH remains constant. The pH of the mixture is then brought to 7.5–8.0, and the mixture is cooled while stirring.

EXAMPLE 4

200 parts of the dimethylpolysiloxane defined in Example 1 and 40 parts of N-stearoylsarcosine (stearic acid sarcoside) are mixed by stirring, and heated to 60° C. Thereafter, a mixture of 160 parts of water a 8 parts of 50% strength aqueous sodium hydroxide solution which has been heated to 60° C. is slowly added to the stirred mixture. The pH is brought to 7.5–8 with 50% strength sodium hydroxide solution, after which the stirred mixture is left to cool.

EXAMPLE 5

200 parts of the dimethylpolysiloxane defined in Example 1 and 40 parts of N-lauroylsarcosine (lauric acid sarcoside) are mixed by stirring, and heated to 60° C. Thereafter, a mixture of 160 parts of water and 8 parts of 50% strength aqueous sodium hydroxide solution which has been heated to 60° C. is slowly added to the stirred mixture. The pH is brought to 7.5–8 with 50% strength sodium hydroxide solution, after which the stirred mixture is left to cool.

EXAMPLE 6

200 parts of the dimethylpolysiloxane defined in Example 1 and 40 parts of N-isononanoylsarcosine (isononanoic acid sarcoside) are mixed by stirring, and heated to 60° C. Thereafter, a mixture of 160 parts of water and 12 parts of 50% strength aqueous sodium hydroxide solution which has been heated to 60° C. is slowly added to the stirred mixture. The mixture is left to cool, while stirring.

EXAMPLE 7

160 parts of the dimethylpolysiloxane defined in Example 1 and 40 parts of N-oleylsarcosine (oleic acid sarcoside) are mixed by stirring, and heated to 60° C. Thereafter, a mixture of 160 parts of water and 17.5 parts of triethanolamine which has been heated to 60° C. is slowly added to the stirred mixture. The mixture is left to cool, while stirring.

EXAMPLES 8 to 11

Preparation of silicone oil emulsions:

50.0 parts of a commercial polysiloxane to be used according to the invention are mixed with 10.0 parts of N-oleoylsarcosine, while stirring, and the mixture is heated to 60° C. A mixture of 36 parts of water and 4 parts of 25% strength aqueous sodium hydroxide solution, which has been heated to 60° C., is then added slowly to the stirred mixture. Complete conversion to the sodium salt is achieved by stirring until the pH remains constant. The pH of the mixture is then brought to 7.8 to 8.0, and the stirred mixture is cooled to room temperature.

A procedure in which the mixture of water and sodium hydroxide solution is initially taken and the mixture of silicone oil and N-oleoylsarcosine is added while stirring gives the same result.

The commercial polysiloxane used in Example 8 is a dimethylpolysiloxane having a viscosity of about 95 mPa.s, that used in Example 9 is a phenylmethylpolysiloxane having a viscosity of about 95 mPa.s, that used in Example 10 is a dimethylpolysiloxane possessing aminofunctional groups and having an amine number of about 0.8–1.0 and a viscosity of from 30 to 50 mPa.s, and that used in Example 11 is a dimethylpolysiloxane having 4 carboxyl groups in the molecule.

B. Use examples

Use example A

Chrome pretanned side leather which has a shaved thickness of 2.2 mm and has been brought to a pH of 5.0–6.0 is drummed in a drum for 1.5 hours at 40° C. with 5% by weight of commercial mimosa extract, 3% by weight of a commercial synthetic tanning agent based on a phenolsulfonic acid/formaldehyde condensate, 1% by weight of a commercial aniline dye and 5% by weight of the silicone oil emulsion stated under Example 1, the percentages being based on the shaved weight; the pH of the 100% strength treatment liquor is 5.2–5.5.

The pH is then brought to 4.5 with 85% strength formic acid, drumming is carried out for 30 minutes and the leather is then washed with water at 40° C. for 10 minutes.

In a fresh bath containing 100% of water at 40° C., a further 3% by weight, based on the shaved weight, of the silicone emulsion stated under Example 1 is drummed into the leather in the course of 30 minutes. The pH is brought to 3.8–4.0 with 85% strength formic acid, and fixing is effected for 90 minutes at 40° C. with 2% by weight of a commercial chrome tanning agent having a $Cr_2O_3$ content of 25% and a basicity of 33%. The leather is then washed, mechanically set up and dried.

Testing in a Bally penetrometer at 15% compression gives the following values:

| | Water absorption after 6 hours | Penetration by water |
|---|---|---|
| Leather without silicone emulsion | 125% | after 4 min |
| Leather with silicone emulsion | 10% | no penetration by water even |

-continued

| | Water absorption after 6 hours | Penetration by water |
|---|---|---|
| | | after 24 h |

Use example B

Chrome tanned side leather brought to a pH of 5.0–6.0 is drummed for 2 hours with 5% by weight of chestnut wood extract, 3% by weight of commercial synthetic tanning agent based on a naphthalenesulfonic acid/formaldehyde condensate, 1% by weight of an aniline dye and a mixture of 6% by weight of a commercial water repellent for leather, based on a paraffin emulsion, and 3% by weight of the silicone oil emulsion described in Example 2, the percentages in each case being based on the shaved weight of the leather.

Thereafter, the pH is brought to 3.8–4.0 with formic acid, and fixing is effected for a further 90 minutes with a commercial chrome tanning agent having a chromium oxide content of about 25% and a basicity of about 33%. The leather is washed and then dried in a conventional manner.

Testing in a Bally penetrometer at 15% compression gives the following values:

| | Water absorption after 6 hours | Penetration by water |
|---|---|---|
| Leather treated only with commercial water repellent based on paraffin emulsion | 45% | after 35 min |
| Leather treated with a mixture of silicone emulsion and paraffin emulsion | 14% | no penetration by water even after 6 h |

Use example C

Chrome tanned side leather (wet blue) is brought to pH 5.0–6.0 and then retanned by drumming for 60 minutes with 7.5% by weight of a mixture of vegetable and synthetic commercial tanning agents based on a naphthalenesulfonic acid/formaldehyde condensate, 1.5% by weight of a commercial aniline dye and 7% by weight of a conventional water repellent for leather, based on a paraffin emulsion, the percentages in each case being based on the shaved weight of the leather, and drumming is then carried out for a further 30 minutes with 3% by weight of the silicone oil emulsion described in Example 1. Drumming is continued for a further 30 minutes, during which the pH is brought to 4.0 with formic acid and fixing is effected with 1.5% by weight of a commercial chrome tanning agent in the course of 90 minutes.

The leather is washed and dried in a conventional manner.

Testing in a Bally penetrometer at 15% compression gives the following values:

| | Water absorption after 6 hours | Penetration by water |
|---|---|---|
| Leather treated only with commercial water repellent | 38% | after 39 minutes |
| Leather additionally after-treated with silicone oil emulsion | 11% | no penetration by water even |

-continued

| | Water absorption after 6 hours | Penetration by water |
|---|---|---|
| | | after 6 h |

Use example D

The wet blue leather brought to a pH of 5.0–6.0 with a commercial neutralizing agent is retanned and dyed as described under Example A, fatliquored with 8% by weight, based on the shaved weight, of a commercial nonwater-repellent fatliquor mixture, brought to a pH of 4.0 and washed.

Drumming is then carried out in fresh liquor (100%, 40° C.) for 30 minutes with 4% by weight of the silicone oil smulsion described under Example 3 containing paraffin and white oil, and fixing is effected for 60 minutes with 1.5% by weight of a commercial chrome tanning agent.

The leather is washed thoroughly, set out, and then dried in a conventional manner.

Testing in a Bally penetrometer at 15% compression gives the following values:

| | Water absorption after 2 hours | Penetration by water after . . . minutes |
|---|---|---|
| Leather treated only with fatliquor | 110% | 2 |
| Leather fatliquored and after-treated with silicone oil emulsion containing paraffin (mp. 52–54° C.) and white oil | 38% | 69 |

Use example E

The chrome tanned leather brought to a pH of 5.0–6.0 is retanned, as described in Example A, with 7% by weight of a mixture of commercial vegetable and synthetic tanning agents based on a phenol condensate, dyed with 1.2% by weight of an aniline dye and fatliquored with 5% by weight of a commercial, non-water-repellent fatliquor for 40 minutes, the percentage in each case being based on the shaved weight of the leather.

Drumming is then carried out for a further 60 minutes with a mixture of 3% by weight of the silicone oil emulsion stated under Example 1 and 3% by weight of a commercial water repellent based on a paraffin emulsion, the pH is brought to 3.8–4.0, fixing is carried out for 60 minutes with 5% by weight of a commercial aluminum salt ($AL_2(SO_4)_3.18H_2O$), and the leather is washed thoroughly and is set out and dried in a conventional manner.

Testing in a Bally penetrometer at 15% compression gives the following values:

| | Water absorption after 2 hours | Penetration by water after . . . minutes |
|---|---|---|
| Leather treated only with fatliquor based on vegetable and animal oils | 112% | 2 |
| Leather fatliquored beforehand and after- | 65% | 18 |

-continued

| | Water absorption after 2 hours | Penetration by water after . . . minutes |
|---|---|---|
| treated with a commercial water repellent based on liquid paraffin | | |
| Leather fatliquored beforehand and after-treated with a mixture of silicone oil emulsion and commercial water repellent | 34% | 65 |

The tests carried out in a Bally penetrometer show substantially improved resistance to water in the dynamic test up to penetration of the first drop of water, and a substantial reduction in the water absorption of the leather compared with the conventional waterproofing process.

Use example F

The procedure described in Example A is followed. Testing the treated leather in a Bally penetrometer at 15% compression gives the following values:

| | Water absorption after 6 hours | Penetration by water |
|---|---|---|
| Leather without silicone emulsion (comparison) | 118% | after 2 min 20 sec |
| Leather with silicone emulsion Example 8 | 13.2% | no penetration by water after 24 h |
| Leather with silicone emulsion Example 9 | 12.5% | no penetration by water after 24 h |
| Leather with silicone emulsion Example 10 | 13.8% | no penetration by water after 24 h |
| Leather with silicone emulsion Example 11 | 18.0% | 2 small drops after 5 h |

We claim:

1. A process for waterproofing leather and skins with a silicone oil in the presence of a salt of an N-($C_9$-$C_{20}$-acyl)-amino acid as an emulsifier, wherein (a) an aqueous emulsion of a silicone oil, consisting of from 15 to 90% by weight of silicone oil, from 5 to 30% by weight of an alkali metal, ammonium or alkanolamine salt of an amino acid of 2 to 6 carbon atoms which has an acyl radical of a saturated or unsaturated fatty acid of 9 to 20 carbon atoms on the amine nitrogen atom, which may additionally be substituted by methyl, and from not less than 5% by weight to the remainder to 100% by weight, of water, the emulsion being brought to pH 5–12, with an alkali metal hydroxide, ammonia or an alkanolamine, or (b) an anhydrous mixture of from 70 to 90% by weight of a silicone oil and from 10 to 30% by weight of an alkanolamine salt of an amino acid of 2 to 6 carbon atoms which has an acyl radical of a saturated or unsaturated fatty acid of 9 to 20 carbon atoms on the amine nitrogen atom, which may additionally be substituted by methyl, in an amount of from 0.5 to 20% by weight, based on the shaved weight of the leather or wet weight of the skins, is allowed to act on the leather or skins being treated, in an aqueous liquor at pH 4.5–8.0, during or after retanning, after which the pH is brought to 3.0–5.0 and, if required, the leather or skins are after-treated in the aqueous solution with a divalent, trivalent or tetravalent metal salt conventionally used in tanning.

2. An emulsion for use in waterproofing leather and skins in an aqueous liquor during or after retanning, consisting of from 15 to 90% by weight of silicone oil, from 5 to 30% by weight of an alkali metal, ammonium or alkanolamine salt of an amino acid of 2 to 6 carbon atoms which has an acyl radical of a fatty acid of 9 to 20 carbon atoms on the amine nitrogen atom, which may additionally be substituted by methyl, and from not less than 5% by weight to the remainder to 100% by weight of water, and the pH being brought to 5–12 with an alkali metal hydroxide, ammonia or an alkanolamine.

3. A mixutre for use in waterproofing leather or skins in an aqueous liquor during or after retanning, consisting of from 70 to 90% by weight of a silicone oil and from 10 to 30% by weight of an alkanolamine salt of an amino acid of 2 to 6 carbon atoms possessing an acyl radical of a saturated or unsaturated fatty acid of 9 to 20 carbon atoms on the amine nitrogen atom, which may additionally be substituted by methyl.

4. Process of claim 1 wherein the silicone oil is a dimethylpolysiloxane, a phenylmethylpolysiloxane, a dimethlpolysiloxane possessing amino groups and having an amine number of about 0.8–1.0, a dimethylpolysiloxane possessing caboxyl groups having an average from 2 to 10 carboxyl groups per molecule, or a dimethylpolysiloxane in which from 1 to 5% of the methyl groups are replaced by mercaptopropyl or aminopropyl groups.

5. The process of claim 1 wherein the silicone oil is a dimethylpolysiloxane in which from 1 to 5% of the methyl groups are replaced by mercaptopropyl or aminopropyl groups.

6. The mixture of claim 3 wherein the silicone oil is a dimethylpolysiloxane, a plenylmethylpolysiloxane, a dimethylpolysiloxane possessing amino groups and having an amine number of about 0.8–1.0, a dimethylpolysiloxane possessing caboxyl groups having an average from 2 to 10 carboxyl groups per molecule, or a dimethylpolysiloxane in which from 1 to 5% of the methyl groups are replaced by mercaptopropyl or aminopropyl groups.

7. The mixture of claim 3 wherein the silicone oil is a dimethylpolysiloxane in which from 1 to 5% of the methyl groups are replaced by mercaptopropyl or aminopropyl groups.

* * * * *